US006612276B2

(12) United States Patent
Cecur

(10) Patent No.: US 6,612,276 B2
(45) Date of Patent: Sep. 2, 2003

(54) ROCKER ARM FOR VALVE TRAINS OF INTERNAL COMBUSTION ENGINES

(75) Inventor: Majo Cecur, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/054,183

(22) Filed: Jan. 22, 2002

(65) Prior Publication Data

US 2002/0108594 A1 Aug. 15, 2002

(30) Foreign Application Priority Data

Feb. 15, 2001 (IT) ..... TO2001A0133

(51) Int. Cl.[7] ..... F01L 1/18

(52) U.S. Cl. ..... 123/90.41; 123/90.44; 123/90.43; 123/90.46; 123/90.36; 123/196 R

(58) Field of Search ..... 123/90.27, 90.42, 123/90.44, 90.39, 90.41, 90.36, 90.43, 90.33, 90.35, 90.46, 196 R, 196 M; 184/6.5, 6.9; 29/888.2

(56) References Cited

U.S. PATENT DOCUMENTS 4,624,223 A * 11/1986 Wherry et al. ..... 123/90.44
4,674,453 A * 6/1987 Dove, Jr. ..... 123/90.39
6,138,626 A * 10/2000 Speil ..... 123/90.39
6,253,721 B1 * 7/2001 Mayer et al. ..... 123/90.39

* cited by examiner

*Primary Examiner*—Thomas Denion
*Assistant Examiner*—Kyle Riddle
(74) *Attorney, Agent, or Firm*—L. J. Kasper

(57) ABSTRACT

The rocker arm (2), obtained from a shaped element (30) made of metallic material, comprises surfaces (15,18) for engagement with a tappet (3) and with a stem (20) of a valve, respectively, and a portion (7) for mounting of a rotatable roller (8) able to co-operate with a cam-type actuating member (4). According to the invention, the surface (15) is formed in an insert (25) produced separately and fixed to the rocker arm. This constructional solution is particularly advantageous when the design constraints, determined by the position of the other elements of the valve train, require a substantial alignment between the center (A) of the surface (15) engaging the tappet, the center (B) of the roller and the contact (C) surface engaging the valve stem (20).

13 Claims, 8 Drawing Sheets

ROCKER ARM FOR VALVE TRAINS OF INTERNAL COMBUSTION ENGINES

CROSS-REFERENCE TO RELATED APPLICATIONS

This application claims priority, under 35 U.S.C. 119, of earlier-filed Italian Application TO2001A000133, filed Feb. 15, 2001.

BACKGROUND OF THE DISCLOSURE

The present invention relates to a rocker arm for valve trains of internal-combustion engines, and more particularly, to rocker arms for use in valve gear trains of the "end-pivot" rocker arm type.

For a better understanding of the state of the art regarding the subject in question and the problems relating thereto, firstly a rocker arm of known design will be described, with reference to FIGS. 6, 7A and 7B of the accompanying drawings.

FIG. 6 is a view, partially sectioned longitudinally, of a valve train, generally designated 1, which is able to cause the alternating rectilinear movement of an engine poppet valve (only a stem 20 of the valve being shown in FIG. 6) in accordance with a predetermined opening sequence. The valve train comprises a rocker arm 2, a hydraulic tappet 3 and a cam-type actuating member 4.

The mutual arrangement of the above-described components may vary depending on the type of engine and the type of distribution chosen. In particular the present invention relates to rocker arms of the type comprising end portions 5 and 6 able to engage the tappet 3 and the valve, respectively, and an intermediate portion 7 intended to receive a roller 8 co-operating with the cam-type actuating member 4. An example of an embodiment of a rocker arm of this type is illustrated in detail in FIGS. 7A and 7B which show longitudinally sectioned and cross sectional views thereof, respectively.

The operating principle of a valve train of the above-mentioned type is well-known to a person skilled in the art: the rotational movement of a cam shaft (which is not shown, but which rotates the cam-type actuating member 4) is converted into the alternating rectilinear movement of the valve. Such rectilinear movement is the result of the interaction between the cam member 4, having a base circle portion 9 and an eccentric profile (lift portion) 10, and the roller 8 of the rocker arm, said interaction acting so as to cause oscillation of the rocker arm in its own longitudinal plane of symmetry (coinciding with the plane of the sheet showing FIG. 6), about a fulcrum point located in the zone of contact between the rocker arm 2 and the tappet 3.

At present this type of rocker arm is advantageously produced by means of the operations of:

(a) shearing of a shaped element 30 (see FIG. 8), from a sheet of steel with a low carbon content, the element 30 having a form symmetrical with respect to a longitudinal axis 35 and being provided with an opening 36, in a substantially intermediate position, and with two holes 21 and 22 situated laterally with respect to the opening 36;

(b) pressing the above-mentioned shaped element 30 in order to perform bending upwards (or downwards) of lateral portions 31 and 32, along bending lines 33 and 34, respectively, so as to provide the part with a substantially U-shaped cross section (see FIG. 7B), having a horizontal plate portion 11 which connects two vertical side walls 12 and 13;

(c) forming the horizontal plate portion 11, at the end 5 of the rocker arm, so as to produce a partly spherical portion 14 having a concave surface of revolution 15 with an essentially ogive-shaped section able to engage with an essentially hemispherical convex outer surface 16 at the top of the hydraulic tappet 3;

(d) forming the above-mentioned horizontal plate portion 11, at the end 6 of the rocker arm, so as to produce a shoe element 17 having a surface 18 with its concavity directed downwards and an arched cross section (in the plane of oscillation of the rocker arm), able to interact with the top (tip) 19 of the stem 20 of the engine poppet valve; and (e) inserting and locking a cylindrical pin 23 in the two seats defined by the above-mentioned holes 21 and 22, the roller 8 being rotatably mounted on the pin 23 by means of rolling elements 24 so as to project partially from the opening 36 in order to engage with the cam member 4.

The shape and dimensions of the rocker arm 2 are dictated by the design requirements of the engine manufacturer and must therefore be able to satisfy precise geometrical constraints associated with predetermined positions, in the engine cylinder head, of the other valve train elements with which the rocker arm 2 must co-operate. The geometrical constraints determine the arrangement, in the plane of longitudinal symmetry of the rocker arm (coinciding with its plane of oscillation), of three significant points A, B and C, indicated in FIG. 6, as follows:

A is a center of the theoretical circumference (or hemisphere) of contact between the engaging surfaces 15 and 16 of the rocker arm 3 and the tappet 4, respectively;

B is a center of the pin 23 of the roller 8; and

C is a theoretical point of contact between the contact surface 18 of the rocker arm 2 and the contact surface on the valve tip 19 of the valve stem 20.

If the design requirements of the engine cylinder head result in the positioning of the above-mentioned point B at a sufficiently large lateral distance from the straight line passing through the other two points A and C at the opposite end zones 5 and 6 of the rocker arm 2, respectively, the rocker arm may be manufactured by means of simple shearing and bending operations, with low production costs.

In order to clarify this point, it should be noted, with reference to FIG. 8, how the central opening 36 of the semi-finished product 30 has an elongated shape in the longitudinal direction, with an intermediate section 37 having a transverse dimension, or width, which is smaller than that of two longitudinal end sections 38 and 39 and how the two holes 21 and 22 are positioned opposite the above-mentioned intermediate section 37. The width of the intermediate section 37 of the opening 36 cannot be less than a certain minimum value imposed by the technological constraints associated with the feasibility of the shearing operation. Consequently, the width of internal flanges 41 and 42 located between the intermediate section 37 and the holes 21 and 22, respectively, has an upper limit value, once the dimensions of the above-mentioned holes and their distance from the axis 35 have been fixed.

In the design situation where the center B of the pin 23 is located underneath the straight line joining the end points A and C, the operation of bending of the lateral portions 31 and 32 of the semi-finished product 30 into a "U" is performed downwards, along the bending lines 33 and 34. These bending lines, viewed in the longitudinal plane of symmetry of the rocker arm, are substantially parallel to the straight line passing through the points A and C. Observing, in FIG. 8, the geometry of the shaped element 30, it can be easily understood that, if the distance of the point B from the straight line passing through the points A and C is fairly large, then the maximum width of the flanges 41 and 42 is sufficient to perform the function of laterally containing the rolling elements 24 (usually rollers) of the roller 8.

When, on the other hand, the center of the pin 23 (point B) must be located above the straight line joining the end points A and C, the above-mentioned operation of bending into a "U" shape is performed upwards, again along the lines 33 and 34. The two internal flanges 41 and 42 are thus positioned, at the end of bending, underneath the holes 21 and 22 of the pin and therefore must no longer perform the function of laterally containing the rolling elements of the roller, but must ensure the necessary flexural stiffness of the rocker-arm body. If, therefore, the distance of the point B from the straight line A–C, i.e. the distance of the centers of the holes 21 and 22 from the bending lines 33 and 34, respectively, is too small, the maximum width of the flanges 41 and 42 may not be sufficient to provide the rocker arm with the required rigidity.

The problem of how to produce a rocker arm by means of pressing therefore arises, in particular, when the design constraints require a substantially aligned position of the three above-mentioned points A, B and C, i.e. essentially the top of the tappet, center of the roller and top of the valve stem.

Known prior art solutions envisage in this case the bending, for example downwards, of the lateral portions 31 and 32 of a shaped element 30 similar to that of FIG. 8, along bending lines which, viewed in the plane of longitudinal symmetry of the rocker arm, no longer substantially coincide with the straight line passing through the end points A and C, but are inclined upwards through an angle such as to ensure a width of the flanges 41 and 42 sufficient for performing the function of containing the rolling elements of the roller. It is therefore necessary to perform a further operation involving plastic deformation in order to displace the end portion 5 of the horizontal plate portion 11 of the rocker arm, which at the end of this first operation is still located aligned with the bending line, downwards as far as the level of the point C. This process is costly since it requires the use of presses capable of generating very high forces.

BRIEF SUMMARY OF THE INVENTION

Accordingly, it is an object of the present invention to provide a rocker arm which, even in the case of substantially aligned positioning of the above-mentioned three points A, B and C, may be produced through simple bending into a "U" shape by means of pressing without the need for further plastic deformation operations which produce a relative displacement of the end portions 5, 6 and the intermediate portion 7 of the rocker arm.

These and other objects and advantages, which will emerge more clearly from the following description, are achieved by providing an improved rocker arm of the type constructed by means of deformation of a shaped element made of metallic material, comprising surfaces for engagement with a tappet and with a stem of a valve, respectively, and a portion for mounting of a rotatable roller, able to co-operate with a cam-type actuating member.

The improved rocker arm is characterized by the fact that the surface of engagement with the hydraulic tappet is formed in an insert fixed to the rocker arm. In accordance with a more limited aspect of the invention, the insert is formed, dimensioned, and positioned so that the surface for engagement with the tappet is essentially aligned with the roller and with the surface for engagement with the poppet valve.

BRIEF DESCRIPTION OF THE DRAWINGS

The invention will be described in greater detail below, purely by way of a non-limiting example, with reference to the accompanying drawings in which.

DETAILED DESCRIPTION OF THE PREFERRED EMBODIMENT

In the following description, only the elements and parts of specific importance and interest for the purposes of understanding the invention will be illustrated in detail; as regards, however, elements and parts not mentioned or considered, reference should be made to the solutions of the known type.

Figure 1:
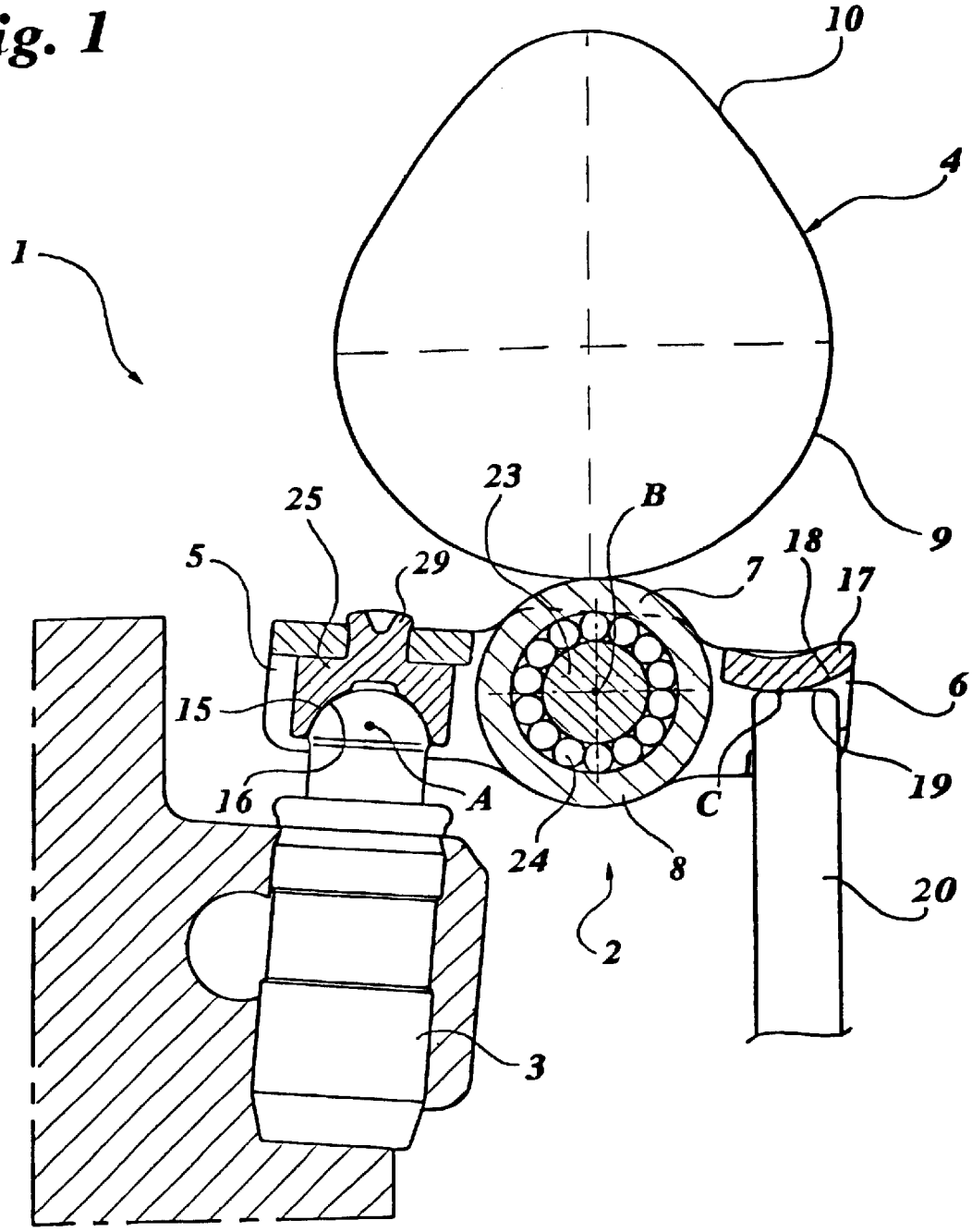
FIG. 1 is a partially longitudinally sectioned view of a valve train provided with a rocker arm according to the invention.
Figure 2A:
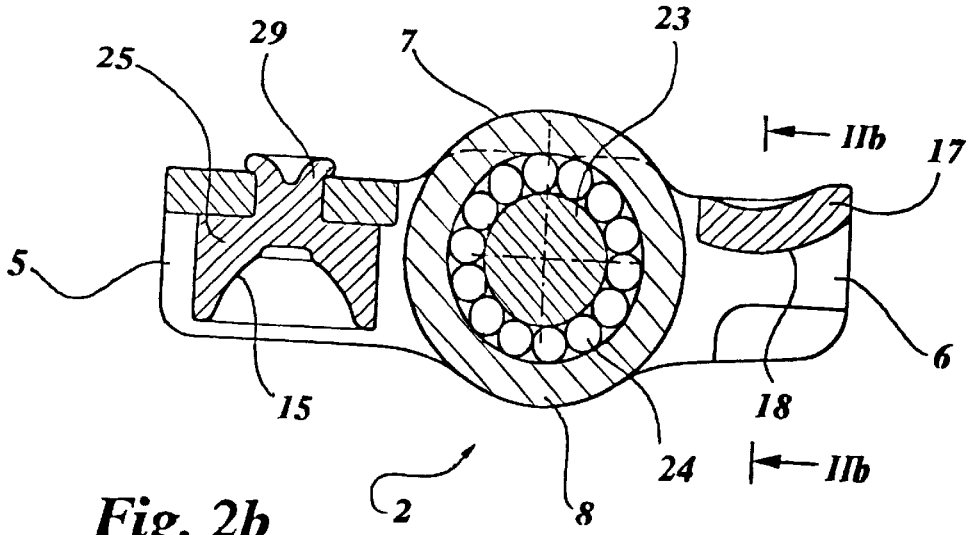
FIGS. 2*a*, 2*b* and 2*c* are, respectively, a longitudinally sectioned view, a laterally sectioned view, and a top plan view of the rocker arm according to FIG. 1.
Figure 2B:
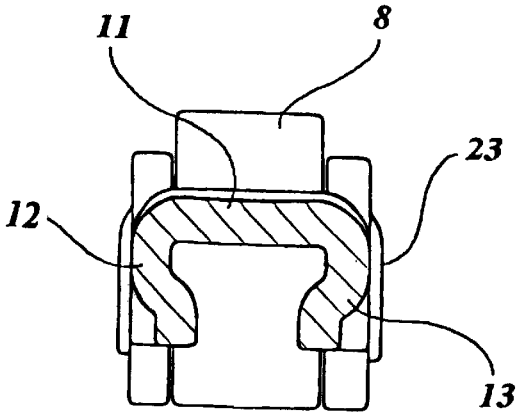
Figure 2C:
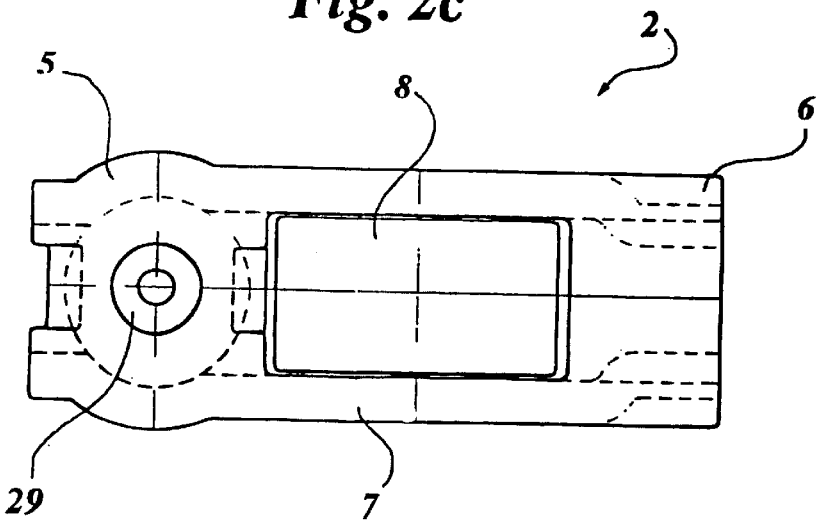
Figure 3:
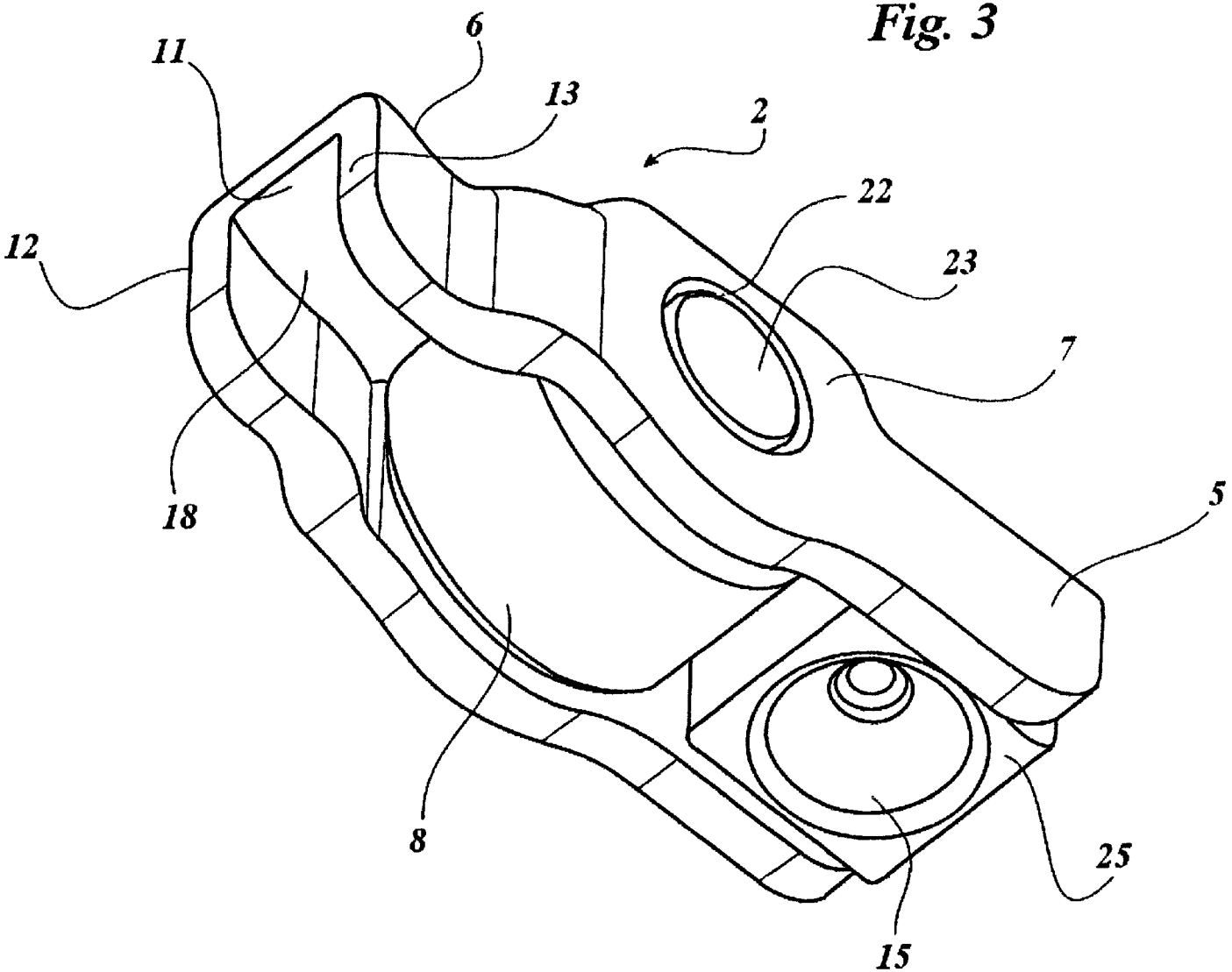
FIG. 3 is a bottom perspective view of the rocker arm of the present invention according to FIG. 1.
Figure 6:
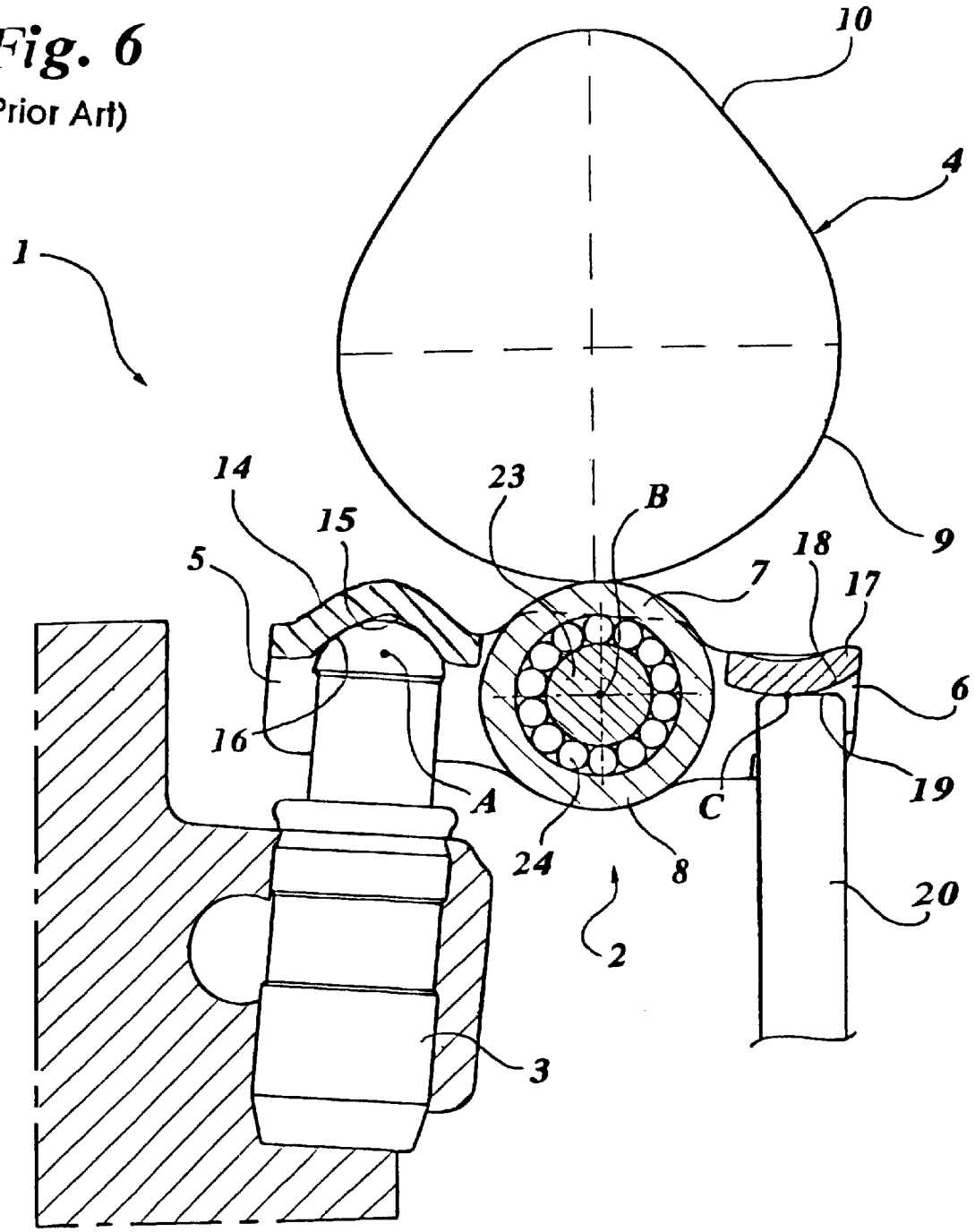
Fig. 6 (Prior Art)
FIG. 6 is a partially longitudinally sectioned view of a valve train provided with a rocker arm of the conventional type.
Figure 7B:
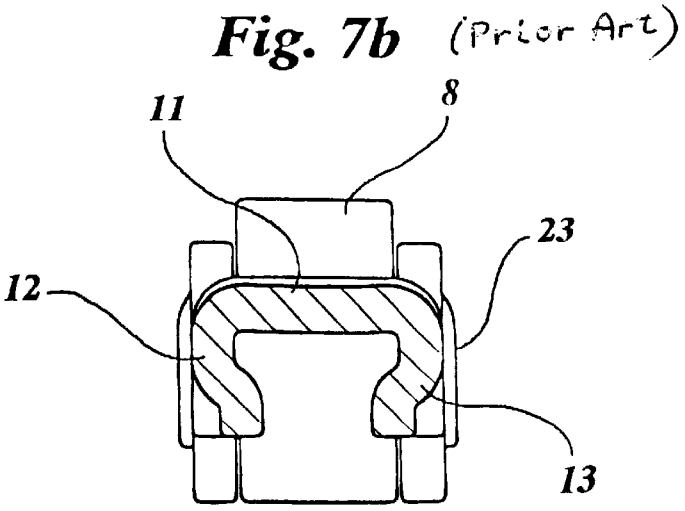
Fig. 7b (Prior Art)
FIGS. 7A and 7B are, respectively, a longitudinally sectioned view and a cross sectional view of the rocker arm according to FIG. 6.
Figure 7A:
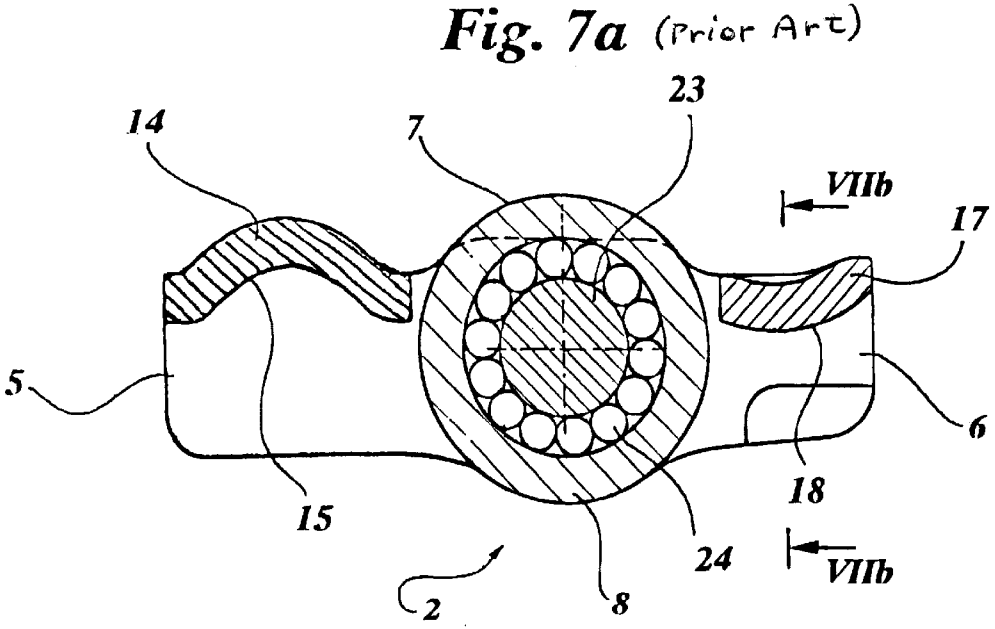
Fig. 7a (Prior Art)
Figure 8:
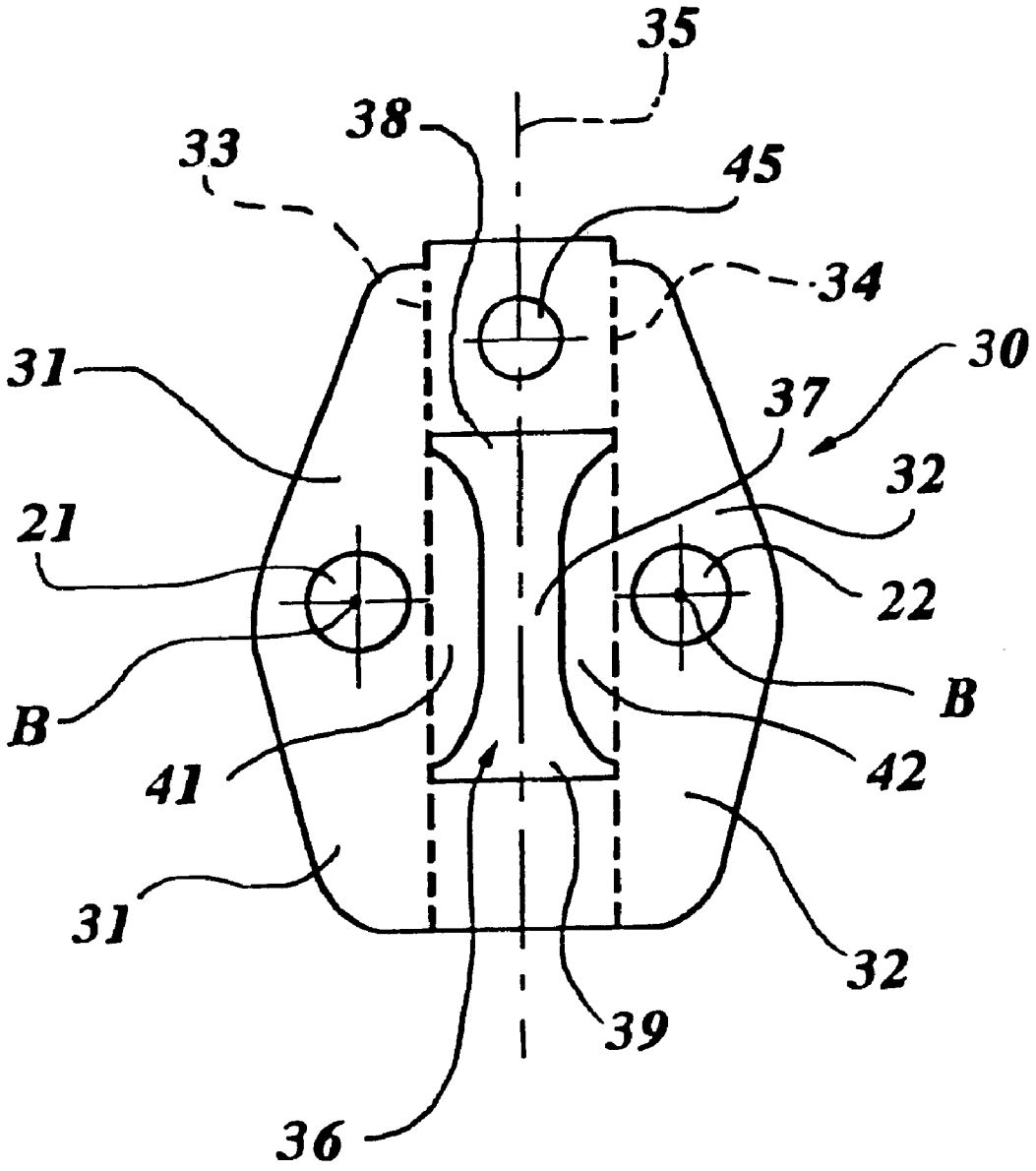
FIG. 8 is a plan view of a semi-finished article for production of the body of a rocker arm made in accordance with the present invention.

FIG. 1 shows a valve train 1 in which the geometric arrangement of its elements is such as to involve a substantial alignment of the three significant points A, B and C previously defined with reference to a known example of a prior art embodiment. The valve train comprises a rocker arm 2 of the same type as that shown in FIG. 6, but with the difference that, according to the invention, the concave surface 15 with an ogive-shaped cross section, able to engage with the respective surface 16 of the hydraulic tappet 3, is formed in an insert 25 produced separately and fixed to the end portion 5 of the rocker arm, instead of being formed directly on this portion by means of a plastic deformation process.

The point A at the center of the theoretical circumference (or hemisphere) of contact between the concave surface 15, formed in the insert 25, and the surface 16 of the top of the tappet is substantially aligned with the center of the roller 8 and with the point C of theoretical contact between the surface 18 of the rocker arm and the top 19 of the valve stem 20.

Figure 4:
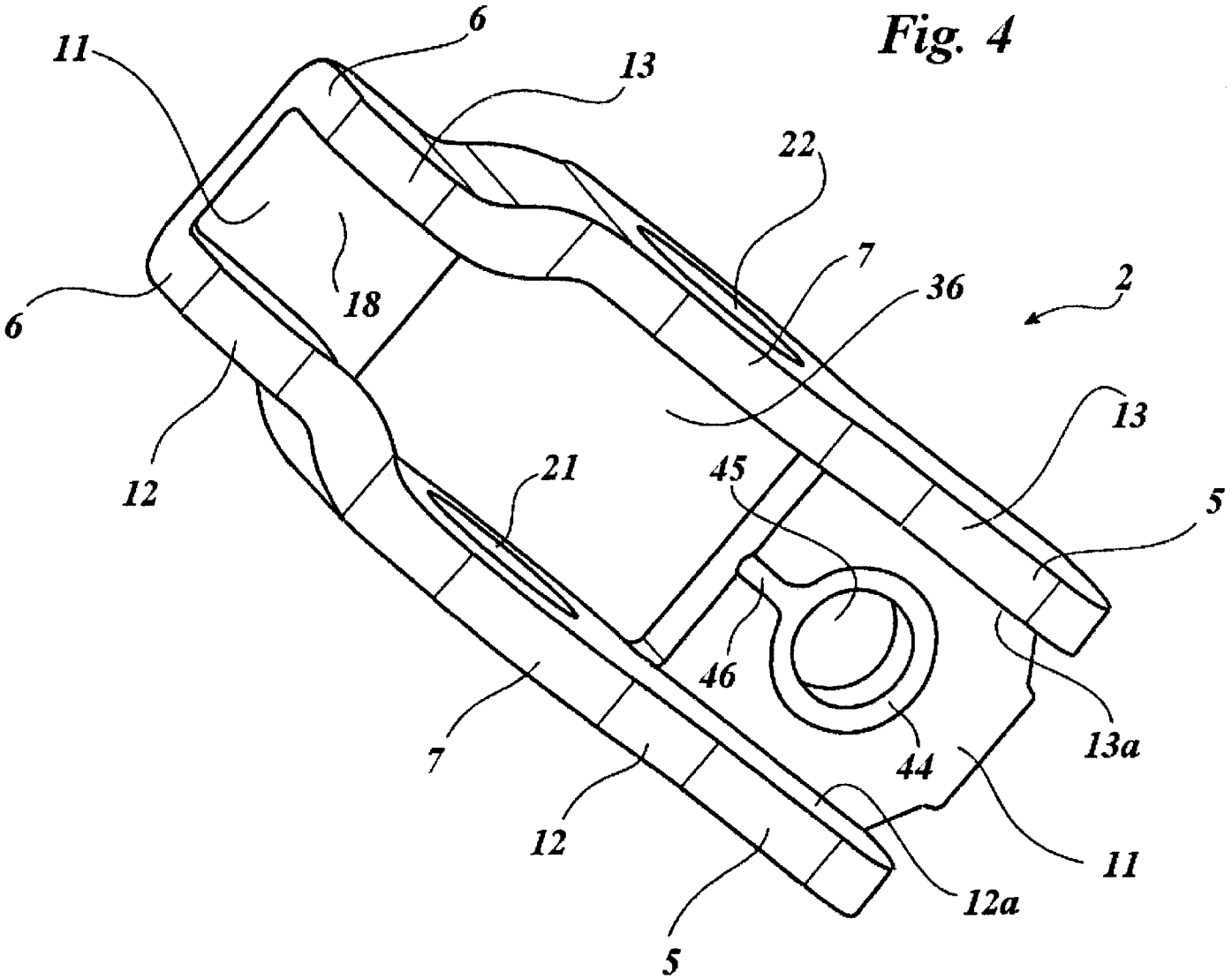
FIG. 4 is a bottom perspective view of the body of the rocker arm according to FIG. 1, without the roller or the insert.

The insert 25, which may be advantageously made by means of cold-pressing (cold forming) from a material which is not necessarily identical to that used for the body of the rocker arm 2, has preferably a parallelepiped shape. The insert 25 has two flat side faces 26 and 27 (FIG. 5) able to mate with respective inner faces 12*a* and 13*a* (visible in FIG. 4) of the side walls 12 and 13 in the end portion 5 of the rocker arm.

Figure 5:
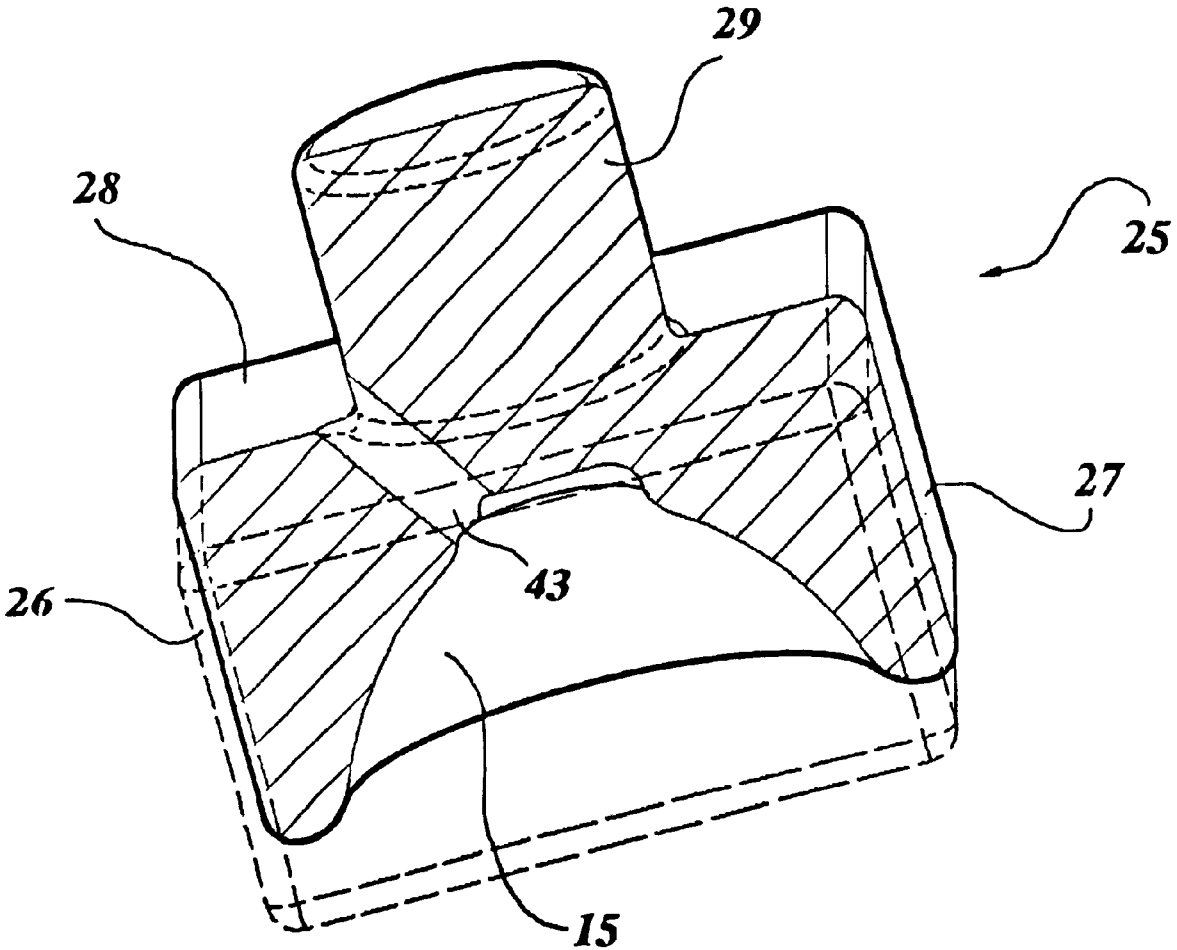
FIG. 5 is a sectioned perspective view of an insert able to be fastened to the rocker arm according to FIG. 1.

With reference still to FIG. 5, in which a preferred embodiment of the insert 25 is shown, it can be seen how, in order to facilitate assembly and engagement with the rocker arm, the insert has, on its upper side 28, a lug 29. The lug 29 is able to be inserted into, and mate with, a hole 45 formed in the horizontal plate portion 11 of the rocker arm in the zone where the insert 25 is housed. The lug 29 may either have only a positioning and centering function during assembly of the insert or form an actual fastening element co-operating with the body of the rocker arm. In this latter case, the lug 29 has a height preferably greater than the thickness of the sheet metal of the rocker arm body, so that once inserted inside the hole 45, an upper end portion extends beyond the upper wall of the horizontal plate portion 11 and is thus capable of being fixed to the wall. This fixing operation may be performed in conventional ways, known to a person skilled in the art, which are simple to perform and not costly, for example, by means of crushing or riveting.

It can therefore be understood how, with a rocker arm according to the invention, it is possible to satisfy fully the design specifications imposed by the engine manufacturer, in terms of geometrical and mechanical characteristics, by means of simple and high-productivity machining operations which can be performed using machines which do not require a high initial outlay. In particular, the adoption of an insert produced separately from the body of the rocker arm means that it is no longer required to perform further plastic deformation operations which require the use of presses capable of generating high pressing forces and therefore having a correspondingly high cost. According to the present invention, in fact, these plastic deformation operations are replaced by cold-pressing of the insert, with the formation of its concave surface having an ogive-shaped cross section (although those skilled in the art will understand that such a shape is by way of example only), and by fixing the insert to the rocker arm body. Such fixing may be advantageously performed, in the case of an insert provided with the mating lug 29, by means of the same type of operation used for locking the pin of the roller in the two holes of the rocker arm body, for example by riveting the top end of the above-mentioned lug 29 in order to produce wedging thereof by means of interference inside the corresponding hole 45.

Another advantage of the rocker arm of the present invention is the "modular" design, because it is possible to use the same type of insert for rocker arms with different shapes and/or dimensions or, vice versa, use inserts with different shapes and/or dimensions for the same type of rocker arm.

It is also possible to manufacture the insert 25 from a material which is different or is treated differently from the shoe 17, so as to satisfy the opposing requirements arising from the two couplings, i.e. the insert/tappet coupling and the shoe/stem coupling. In the first case, in fact, the coupling between the concave ogive-shaped surface of revolution 15 of the insert and the substantially hemispherical surface 16 of the tappet produces low contact stresses, but high frictional wear; on the other hand, the coupling between the convex surface 18 of the shoe with an arched cross section and the generally flat surface at the top 19 of the valve stem 20 produces high contact stresses, but low frictional wear.

Another advantageous feature of the invention consists of the possibility of implementing a simple but effective system for lubricating the roller, based on the use of the oil which is supplied from the hydraulic tappet and which has the function of lubricating the surfaces 15 and 16 of contact between the tappet 3 and the rocker arm 2. With reference to FIG. 5, a through-hole 43 of small diameter is formed at the top of the ogive-shaped surface 15 of the insert, the hole 43 allowing the lubricating oil to flow from the zone of engagement with the top end of the tappet towards the upper surface of the insert around the lug 29. The oil may thus be collected in an impression 44 (FIG. 4) formed in the bottom wall of the horizontal plate portion 11 of the rocker arm around the hole 45 and distributed towards the roller by means of a channel 46. The channel 46 is also formed on the bottom wall of the plate portion 11 so as to perform lubrication of the contact surfaces of the roller 8 and the cam member 4. In addition to the channel 46 which can be seen in FIG. 4, arranged longitudinally, other channels may also be formed, for example two channels arranged laterally on opposite sides of the above-mentioned channel 46 so as to convey part of the oil collected in the impression 44 towards the two zones of frictional contact between the side surfaces of the roller and the inner faces of the side walls 12 and 13 of the rocker arm body.

Obviously, without modifying the principle of the invention, the embodiments and the constructional details may be greatly varied from that described and illustrated purely by way of a non-limiting example, without thereby departing from the scope of the invention as defined in the accompanying claims.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rocker arm for a valve train of an internal-combustion engine, of the type constructed by means of deformation of a shaped element made from a flat piece of metallic material, comprising surfaces for engagement with a tappet and with a stem of a valve, respectively, and an intermediate portion for mounting of a rotatable roller able to co-operate with a cam-type actuating member and being of the type comprising a body with a substantially U-shaped cross section, having a horizontal plate portion connecting two vertical side walls, characterized in that said surface of engagement with said tappet is formed in an insert fixed to said rocker arm, and in that said insert has two opposite side faces able to mate with respective interfaces of said vertical side walls of said rocker arm, and in that said insert has a substantially parallelepiped shape.

2. A rocker arm according to claim 1, characterized in that said insert is formed, dimensioned and positioned so that said surface for engagement with said tappet is essentially aligned with said roller and with said surface for engagement with said valve.

3. A rocker arm according to claim 1, characterized in that said insert is provided at the top with a lug able to engage a hole formed in said plate portion of said rocker arm.

4. A rocker arm according to claim 3, characterized in that said lug is firmly fixed to said rocker arm, in order to fix firmly said insert in said rocker arm.

5. A rocker arm according to claim 4, characterized in that said lug is firmly fixed to said rocker arm by means of cold deformation.

6. A rocker arm according to claim 4, characterized in that said lug of said insert has a height such as to allow fixing thereof to the plate portion of the rocker arm by means of a crushing or a riveting operation.

7. A rocker arm according to claim 3, characterized in that said horizontal plate portion has a hole for insertion and fixing of said lug.

8. A rocker arm according to claim 1, characterized in that said insert is formed by means of cold-pressing or cold forming.

9. A rocker arm according to claim 1, characterized in that said insert is made of a material different from that of the rocker arm.

10. A rocker arm according to claim 1, characterized in that said insert is subjected to surface treatments different from those of the rocker arm body.

11. A rocker arm according to claim 1, characterized in that said insert has a through-hole which allows lubricating oil to pass from the zone of said surface engaging said tappet towards the zone of the roller in order to lubricate the latter.

12. A rocker arm according to claim 11, characterized in that said insert has a concave-shaped impression formed in a bottom wall of said horizontal plate portion opposite the insert and at least one channel able to connect said impression with said intermediate portion of said rocker arm, in order to convey the oil which has collected in said impression towards said roller for lubrication of said roller.

13. A rocker arm according to claim 1, characterized in that said rocker arm body with a U-shaped cross section is obtained by means of bending of a shaped element formed by means of shearing of a sheet-metal strip.

* * * * *